US006470998B1

(12) United States Patent
White

(10) Patent No.: US 6,470,998 B1
(45) Date of Patent: Oct. 29, 2002

(54) MODULAR MUFFLER WITH END PLATE ADAPTORS AND SPARK ARRESTERS

(76) Inventor: James E. White, P.O. Box 96, 479 U.S. Highway 250 North, Greenwich, OH (US) 44837

( * ) Notice: Subject to any disclaimer, the term of this patent is extended or adjusted under 35 U.S.C. 154(b) by 0 days.

(21) Appl. No.: 09/697,477

(22) Filed: Oct. 26, 2000

(51) Int. Cl.[7] ..... F01N 7/18

(52) U.S. Cl. ..... 181/243; 181/238; 181/239; 181/255; 181/265; 181/282

(58) Field of Search ..... 181/227, 228, 181/232, 238, 239, 243, 249, 252, 255, 256, 269, 272, 282

(56) References Cited

U.S. PATENT DOCUMENTS

| | | | | | |
|---|---|---|---|---|---|
| 1,021,254 | A | | 3/1912 | Larkins | |
| 1,401,368 | A | | 12/1921 | Schneebeli | |
| 1,989,595 | A | * | 1/1935 | Hedrick | 181/243 |
| 1,995,542 | A | * | 3/1935 | Halivand | 181/243 |
| 1,995,840 | A | * | 3/1935 | Compo | 181/243 |
| 2,065,232 | A | | 12/1936 | MacKenzie et al. | |
| 2,404,589 | A | | 7/1946 | Monaghan | |
| 2,520,756 | A | | 8/1950 | Bryant | |
| 3,200,902 | A | * | 8/1965 | Jones | 181/282 |
| 3,317,001 | A | | 5/1967 | Powers et al. | |
| 3,404,445 | A | | 10/1968 | Crouse | |
| 4,113,050 | A | | 9/1978 | Smith | |
| 4,338,890 | A | | 7/1982 | Shelby et al. | |
| 4,484,659 | A | | 11/1984 | Buchwalder | |
| 4,570,322 | A | * | 2/1986 | Dence | 181/243 |
| 5,020,631 | A | * | 6/1991 | DeVille | 181/249 |
| 5,248,859 | A | * | 9/1993 | Borla | 181/238 |
| 5,371,331 | A | | 12/1994 | Wall | |
| 5,578,277 | A | | 11/1996 | White et al. | |

* cited by examiner

*Primary Examiner*—Khanh Dang
(74) *Attorney, Agent, or Firm*—Hahn Loeser + Parks, LLP

(57) ABSTRACT

A modular muffler that is quickly and easily adapted for use with a wide variety engines is disclosed. The muffler has a dimensionally standardized body member with end portions that may receive any of a number of adaptor end plates provided with various inlet and outlet configurations. The adaptor end plates are inwardly and outwardly adjustable relative to the body member end portions in order to vary the body member internal volume.

22 Claims, 11 Drawing Sheets

MODULAR MUFFLER WITH END PLATE ADAPTORS AND SPARK ARRESTERS

FIELD OF THE INVENTION

The present invention relates generally to mufflers used to deaden sound in exhaust gas streams generated by internal combustion engines, and more particularly, to a modular muffler that is quickly and easily adapted for use with a wide variety engines. The muffler has a dimensionally standardized body with end portions that may receive any of a number of adaptor end plates provided with various inlet and outlet configurations.

BACKGROUND OF THE INVENTION

Motor vehicles, whether they be automobiles, light trucks, vans, heavy-duty trucks, buses, etc., are most often powered by various types of internal combustion engines. These types of internal combustion engines, and the many different manufacturers models thereof, vary considerably in terms of their design, operating and performance characteristics, and consequently, they typically result in the production, distribution, storage and use of a widely divergent array of muffler systems that are tailor-made to provide not only a desired amount of exhaust gas noise attenuation, but also a suitable level of exhaust system back pressure for each engine model and type.

Attendant with such diversity of systems is increased cost at virtually every commercial stage. Manufacturing expense is boosted by the need to have multiple types of tooling to produce and assemble a multiplicity of perhaps similar yet different sized muffler parts. Storage and inventory cost is inflated by the requirement that a large number of stock keeping units (SKU's) must be assigned, recorded and maintained, considerable floor space must be set aside for storage, and complex systems must be acquired and maintained to monitor and replenish supplies of the systems. Shipping and handling outlays can also be considerable due to the need to ship order sizes which are less than economic order quantities.

In view of the foregoing a need exists to provide a modular muffler construction that not only is highly versatile and thus capable of being used effectively with a variety of engine types and models, but also is more economical to fabricate, acquire, store and install.

SUMMARY OF THE INVENTION

The present invention is a modular muffler construction that may be quickly and easily adapted for use with a wide variety of internal combustion engine types and manufacturers models thereof. The muffler construction generally comprises a universally-sized, central body member provided with a pair of longitudinally separated open ends. Each open end is capable of receiving an end adaptor plate, a body adaptor, an end cap and/or a vehicle adapter. The body member preferably will be elongated along its central longitudinal axis. It will internally include a pair of diagonally arranged perforated tubes that extend from a first end chamber situated at, and defining one of the open ends to a second end chamber located at and defining the other of the open ends of the body. The body member will further include a plurality of layers of sound deadening material that extend lengthwise along the interior of the body and inwardly toward the perforated tubes so as to wrap the tubes in a noise attenuating blanket. The end adaptor plate may be provided with one or more orifices through which exhaust gas may flow. The orifice(s) may be of any desired diameter and/or may be positioned in any of a number of different locations on the plate. The end adaptor plates, once received within an open body member end, may also be adjusted inwardly and outwardly relative to the end in order to vary the internal volume of the body member.

More than one of the muffler body members may be arranged end-to-end, and joined together either by direct contact between their ends or by linking the ends via a body adaptor. The body adaptor may be provided with a deflector plate to facilitate exhaust gas flow between the body members, and it may alternatively be utilized not as a means to join body members, but to install flow restrictors to create turbulence to control flow and sound, and to provide an exhaust gas expansion chamber on one or both ends of a sole body member.

The end cap preferably will be a dome-shaped structure, which, when applied to one of the open ends of the body member, will permit exhaust gas that has entered the body member from the opposite end and traveled to the end cap to be diverted by 180 degrees and caused to journey back through the body member and to exit the muffler from the end through which gained entry. Alternatively, the end cap may be partially dome-shaped and additionally include a tubular extension that allows at least some of the exhaust gas to exit from the end cap.

The vehicle adaptor is a duct-like member that, in addition to having a radially outward extending flange portion for receipt by an open end of the body member, preferably has an outer end portion that is cylindrically shaped and a intermediate portion that is semi-hyperboloid shaped. The vehicle adaptor permits the muffler body member to be used with more than one category of vehicle. By way of example, the vehicle adaptor makes it possible for the one or more of the muffler body members to be applied to larger diameter components (pipes and pipe-like inlets and outlets) of the exhaust systems of heavy duty trucks in addition to smaller diameter components of the exhaust systems of automobiles, light trucks, vans, and the like.

The modular muffler construction can further include one or more spark arresters, past which the exhaust gas is caused to flow. Preferably, the spark arrester(s) will be contained within the second end chamber of the body member and be secured to an end adaptor plate and at an exhaust gas exit orifice provided therein. Inclusion of one or more spark arresters in such manner has been found to be particularly useful for off-road vehicle applications.

The modular muffler may also be constructed so that elongated, exhaust gas carrying tubes extend from the outboard side of an end adaptor plate, through the plate orifices, into the end chamber of the body member and toward the diagonally arranged tubes within the central portion of the body member. The elongated, exhaust gas carrying tubes can be louvered and/or perforated to obtain desired flow and sound levels.

Given the above described modular muffler construction it should be evident that the present invention has as one of its objectives significantly reducing the number and types of different muffler systems and their constituent parts that have to be produced. As previously suggested, achievement of this objective can be expected to yield a number of advantages including, but not limited to, assignment, maintaining and monitoring of fewer SKU's, lowering production tooling costs and storage space allocations, paring distribution expenses and providing vehicle manufacturing and repair facilities with the ability to quickly and easily assemble muffler systems for a multitude of configurations. These advantages and others will become more readily apparent from a review of the following detailed description of the invention and of the drawings attached hereto.

DETAILED DESCRIPTION OF THE PREFERRED EMBODIMENT

Reference will now be made in detail to the present preferred embodiments of the present invention, examples of which are illustrated in the accompanying drawings. Whenever possible, the same reference numbers will be used throughout the drawings to refer to the same or like parts.

Figure 1:
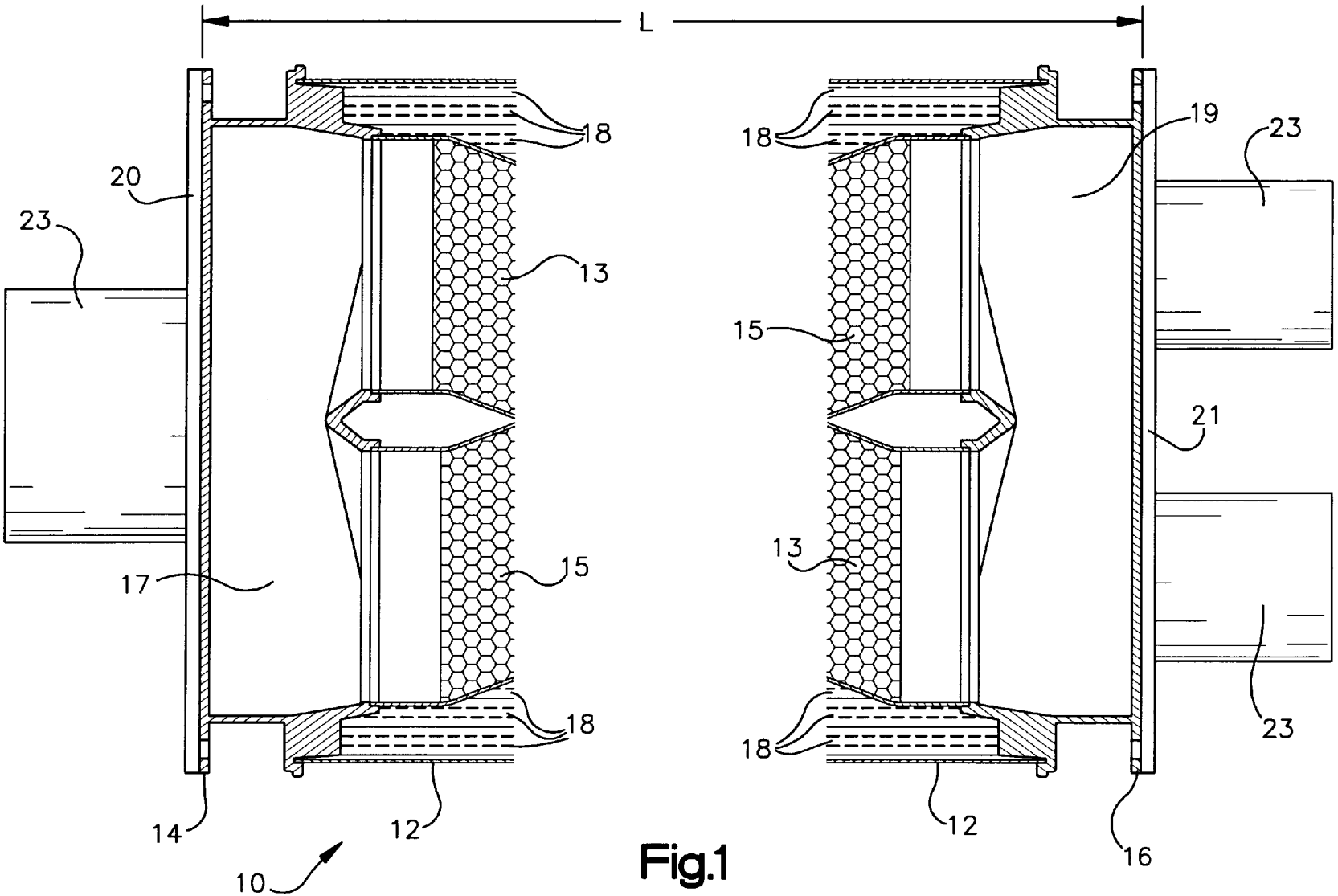
FIG. 1 shows a top cross sectional view (central portion omitted) of one embodiment of the modular muffler construction of the present invention.
Figure 2:
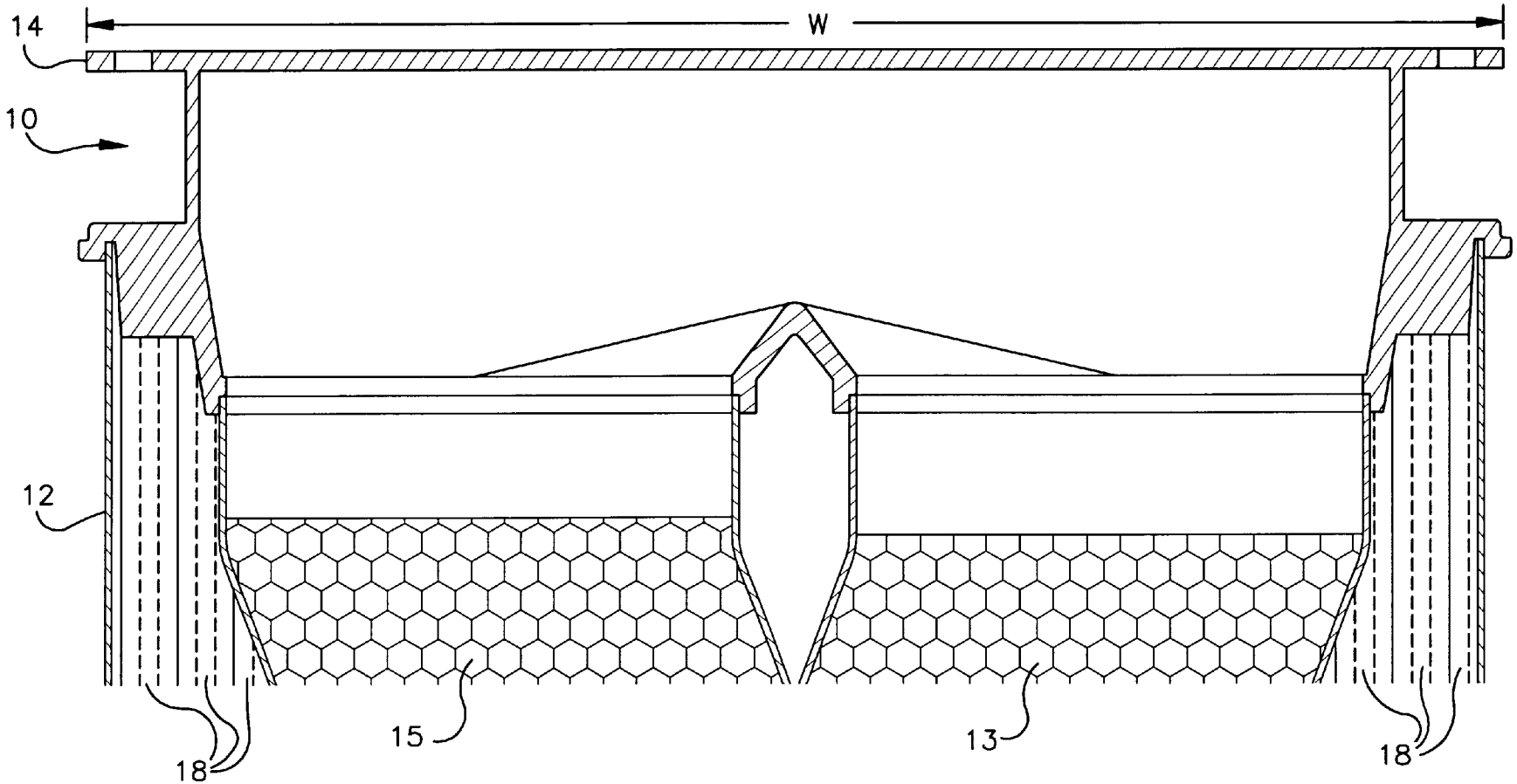
FIG. 2 shows an enlarged top cross sectional view of the end portion of the central body member of the muffler construction of the present invention.

A modular muffler construction in accordance with the present invention is indicated generally in FIGS. 1 and 2 by the reference numeral 10. The muffler construction 10 generally includes a central body member 12 that is produced with a pair of longitudinally separated, outwardly flanged open ends 14 and 16. The central body member 12 has an overall length "L" and an overall width "W", which in the case of the preferred embodiment are 14 inches and 9 inches, respectively. The central body 12 is provided with a pair of tubes or conduits 13 and 15 which extend diagonally across the central body. Each of the tubes 13 and 15 is fabricated with perforated wall material that permits the passage of exhaust gas from the inside to the outside of the tubes 13 and 15 and toward a plurality of layers of sound deadening material 18 that extend lengthwise along the interior of the body 12 and inwardly therefrom toward the tubes 13 and 15. The central body 12 is also provided at its opposing end regions with end chambers 17 and 19 which openly communicate with the tubes 13 and 15. Various known sound deadening materials can be utilized with the present invention. For example, materials such as vermiculate coated fiberglass fabric, including the material sold under the trademark "ZETEX PLUS", manufactured by New Tex Industries, Inc.

Figure 3:
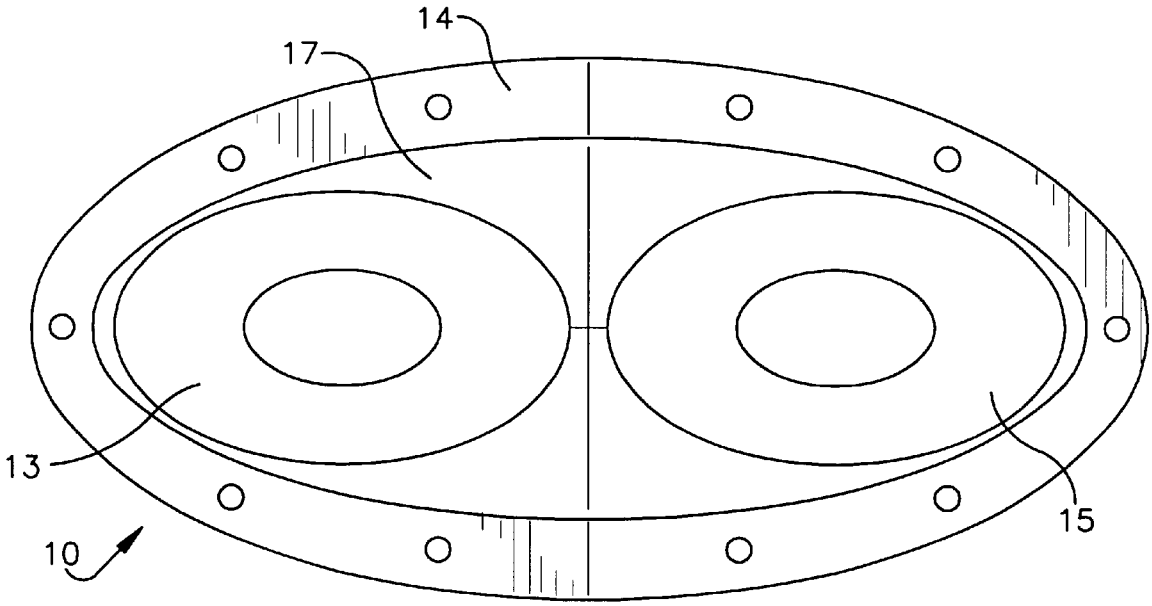
FIG. 3 shows an end view of the central body member of the muffler construction of the present invention.
Figure 4:
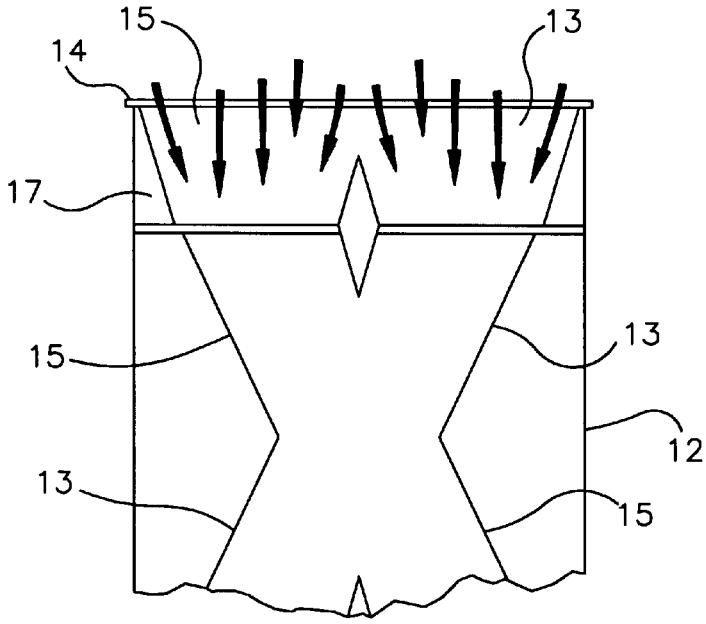
FIG. 4 shows a cutaway top view of the central body member of the muffler construction of the present invention, including an end portion and a substantial portion of the body member's midsection.
Figure 5:
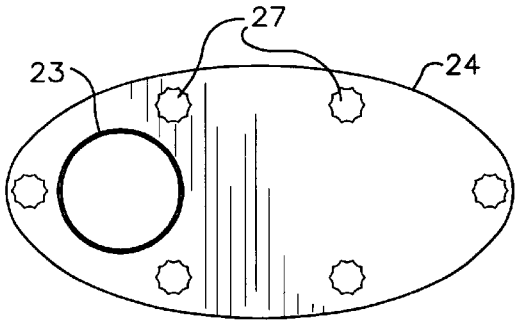
FIGS. 5, 7 and 9 show a front view of adaptor end plates of the muffler construction of the present invention.
Figure 6:
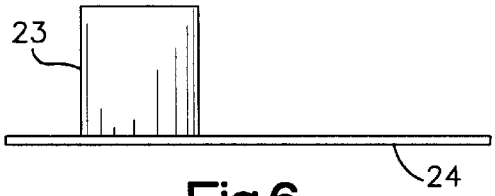
FIGS. 6, 8 and 10 show a side view of the adaptor end plates shown in FIGS. 5, 7 and 9, respectively.
Figure 7:
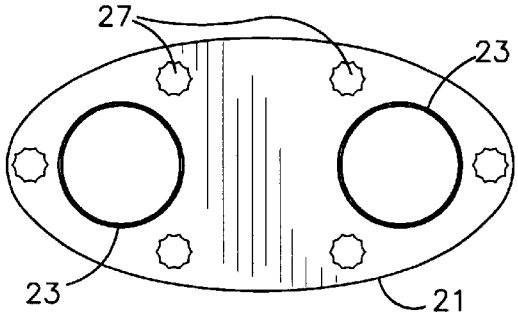
Figure 8:
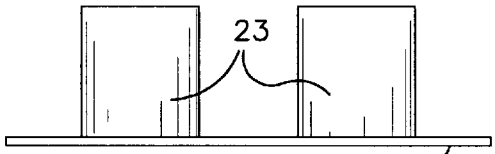
Figure 9:
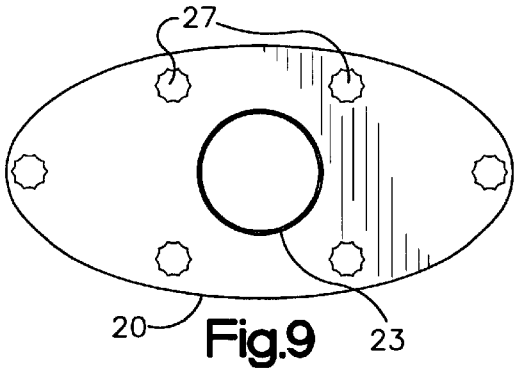
Figure 10:
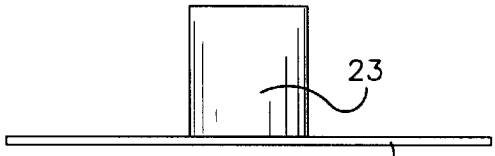
Figure 17:
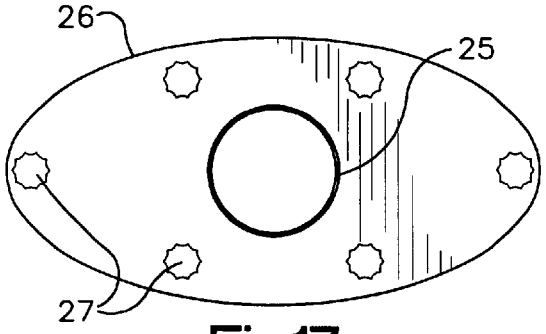
FIG. 17 shows a front view of yet another adaptor end plate of the muffler construction of the present invention.
Figure 18:
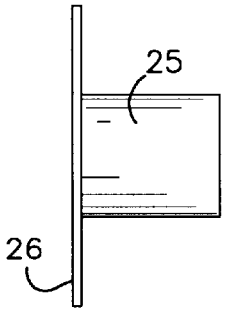
FIG. 18 shows a side view of the adaptor end plate shown in FIG. 17.

As most clearly shown in FIG. 3, the outwardly flanged open end 14 of the central body 12 is provided with a plurality of bores 22 which preferably are threaded internally. The outwardly flanged open end 16 is similarly provided with a plurality of bores 22. The plurality of bores provided at the ends 14 and 16 facilitate the attachment thereto of end adaptor plates 20 and 21 which may have one or more tubular extensions 23 extending outwardly therefrom. As shown in FIGS. 5 through 18, the adaptor plates 20 and 21 are just two examples of a variety of adaptor plates that may be attached to the muffler central body 12. FIGS. 5 and 6 show an adaptor plate 24 having a single tubular extension 23 which is situated to the left of the vertical center line of the plate. FIGS. 7 and 8 show the adaptor plate 21 which has a pair of horizontally aligned extensions 23 which are positioned to the left and the right of the plate's vertical center line. FIGS. 9 and 10 show the adaptor plate 20 which has a singular extension 23 that is centrally located on the plate. FIGS. 17 and 18 show the adaptor plate 26 which resembles the plate 20; however, the plate 26 has a larger diameter, centrally located tubular extension 25. All of the adaptor plates 20, 21, 24 and 26 are provided with a plurality of bores about their peripheral region. The bores are sized and located so that they may be aligned with the plurality of bores 22 provided in the open ends 14 and 16 of the muffler central body 12 and so that they may receive fasteners 27 to hold them finally against the flanges 14 and 16. Various fasteners as are known in the art can be utilized to attach adaptor plates 20, 21, 24 and 26 to open ends 14 and 16, including, including but not limited to bolts, screws, and clamps. Furthermore, the adaptor plates 20, 21, 24 and 26 may be attached to open ends 14 and 16 by welding the elements together. The end adaptor plates 20, 21, 24 and 26 may also be provided with means for allowing them to be adjusted inwardly and outwardly relative the ends 14 and 16 in order to vary the internal volume of the body member 12 and to thus also modify its sound attenuation capabilities.

Figure 11:
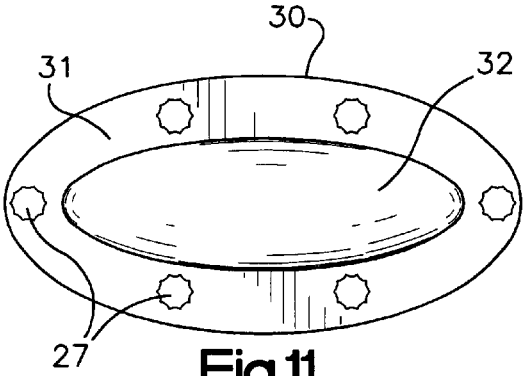
FIGS. 11 and 14 show a front view of the end caps shown in FIGS. 12 and 13.
Figure 12:
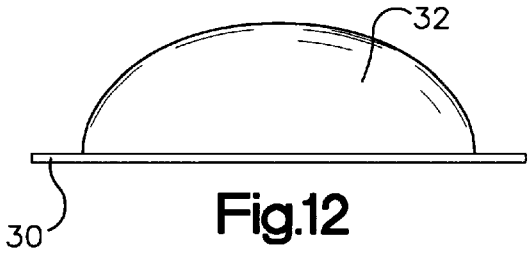
FIGS. 12 and 13 show a side view of end caps of the muffler construction of the present invention.
Figure 13:
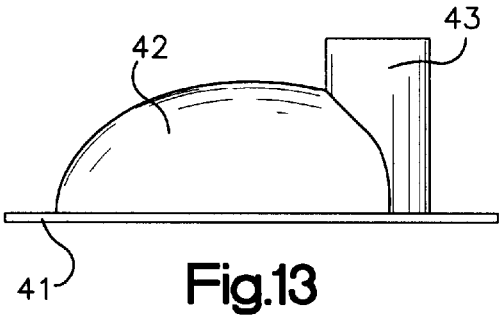
Figure 14:
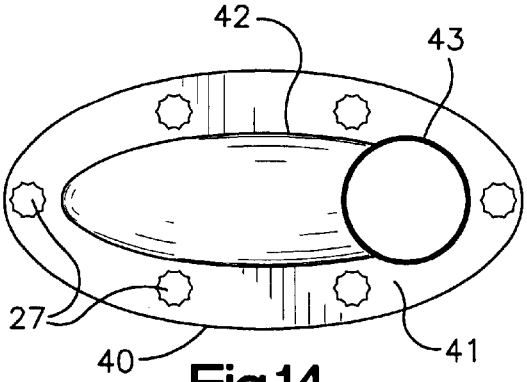
Figure 15:
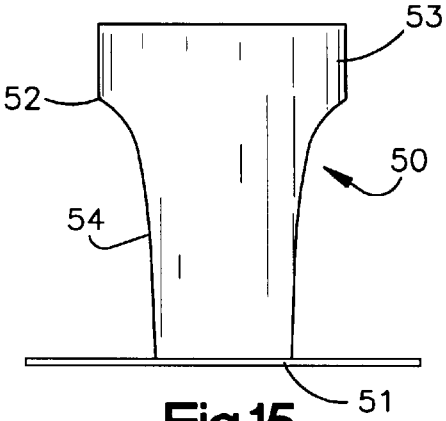
FIG. 15 shows a side view of a vehicle adaptor of the muffler construction of the present invention.
Figure 16:
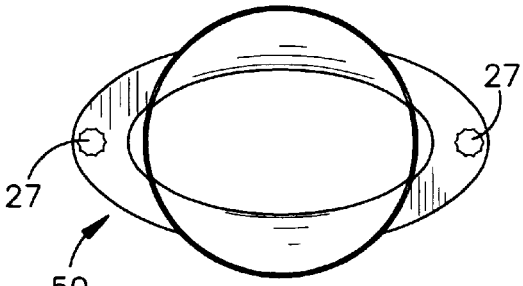
FIG. 16 shows a front view of the vehicle adaptor shown in FIG. 15.

FIGS. 11 through 16 illustrate a variety of additional end structures which may be attached to the open ends 14 and 16 of the central body 12. FIGS. 11 and 12 show an end cap 30. The end cap 30 is comprised of an base flange 31 and a dome-shaped central portion 32. FIGS. 13 and 14 show yet another end cap 40. The end cap 40 has a base flange 41, a domed portion 42 and an outwardly protruding tubular member 43 which is off-set from the central portion of the dome portion 42. FIGS. 15 and 16 show a duct-like vehicle adaptor 50 that is comprised of a base portion 51 and an outwardly projecting portion 52 that resembles a funnel. The funnel-like portion includes a cylindrically shaped outer end portion 53 and a semi-hyperboloid shaped intermediate portion 54.

Figure 19:
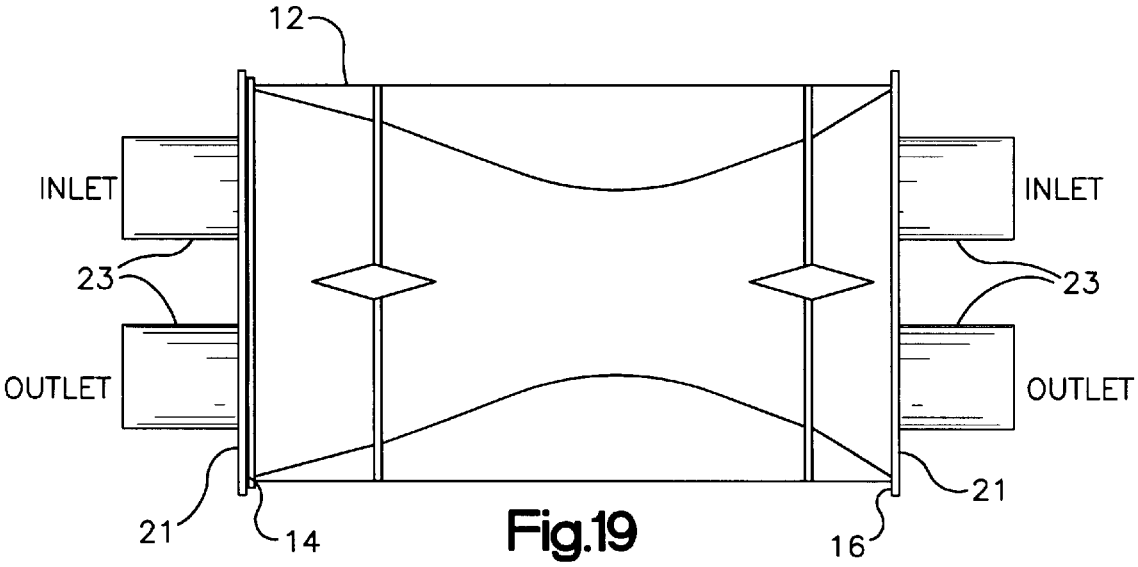
FIGS. 19 and 20 show a top, partially cross sectional view of the muffler body member provided at each open end with an adaptor end plate as shown in FIG. 7.
Figure 20:
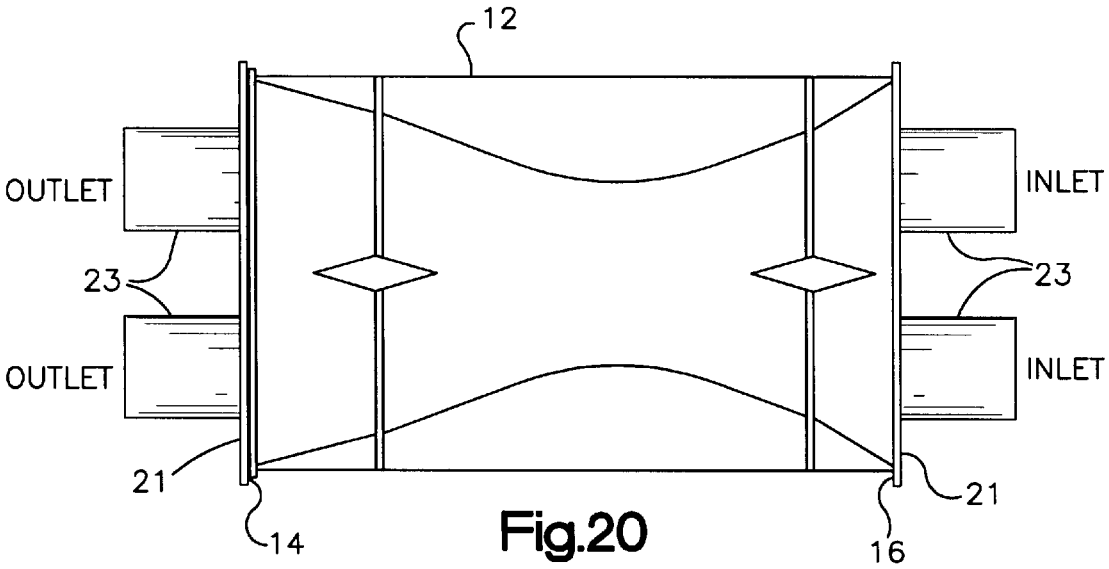
Figure 21:
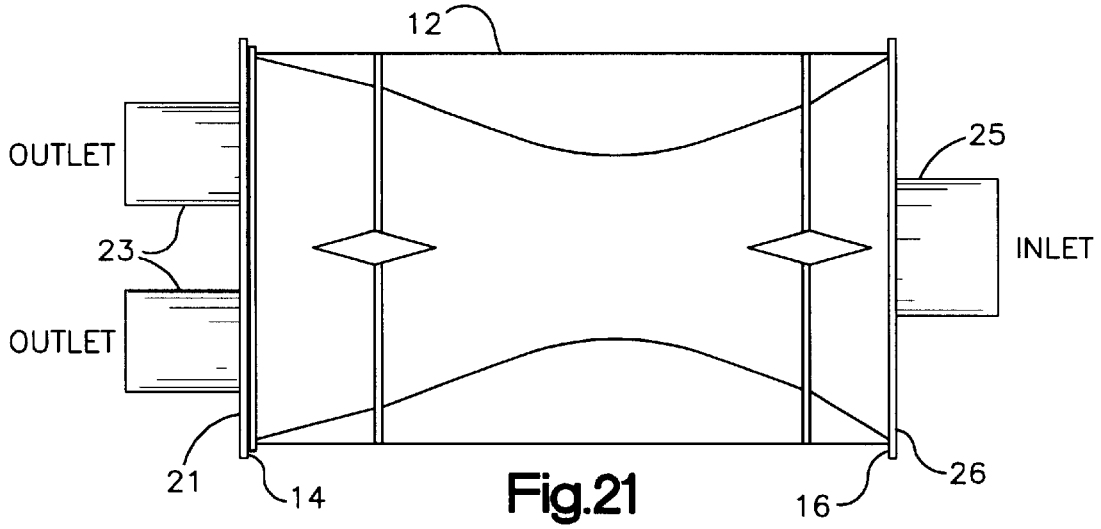
FIG. 21 shows a top, partially cross sectional view of the muffler body member provided at one open end with an adaptor end plate as shown in FIG. 7 and at another open end with an adaptor end plate as shown in FIG. 17.
Figure 22:
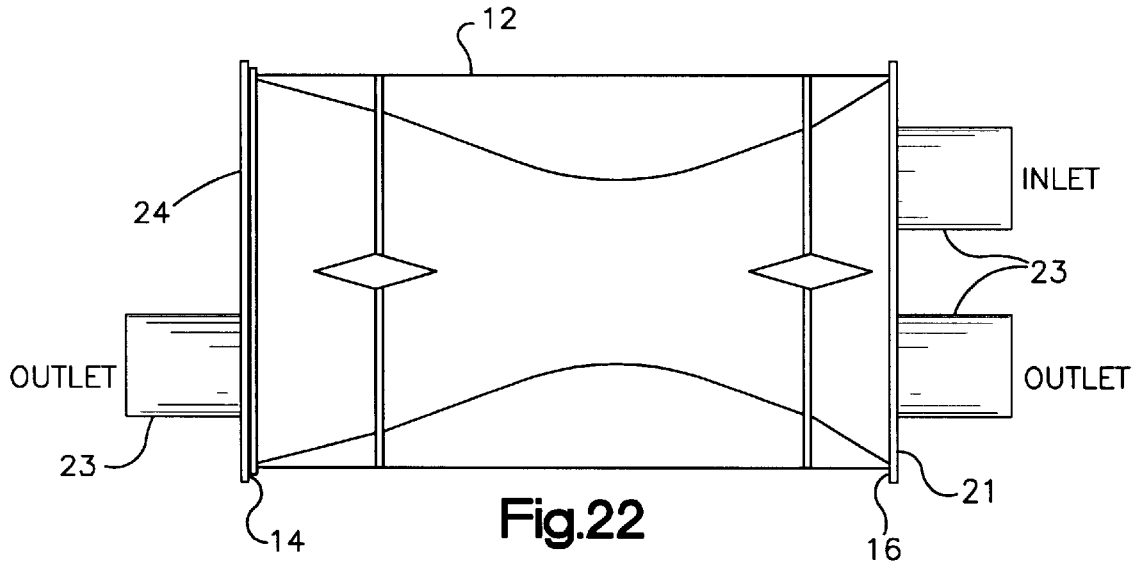
FIG. 22 shows a top, partially cross sectional view of the muffler body member provided at one open end with an adaptor end plate as shown in FIG. 5 and at another open end with an adaptor end plate as shown in FIG. 7.
Figure 23:
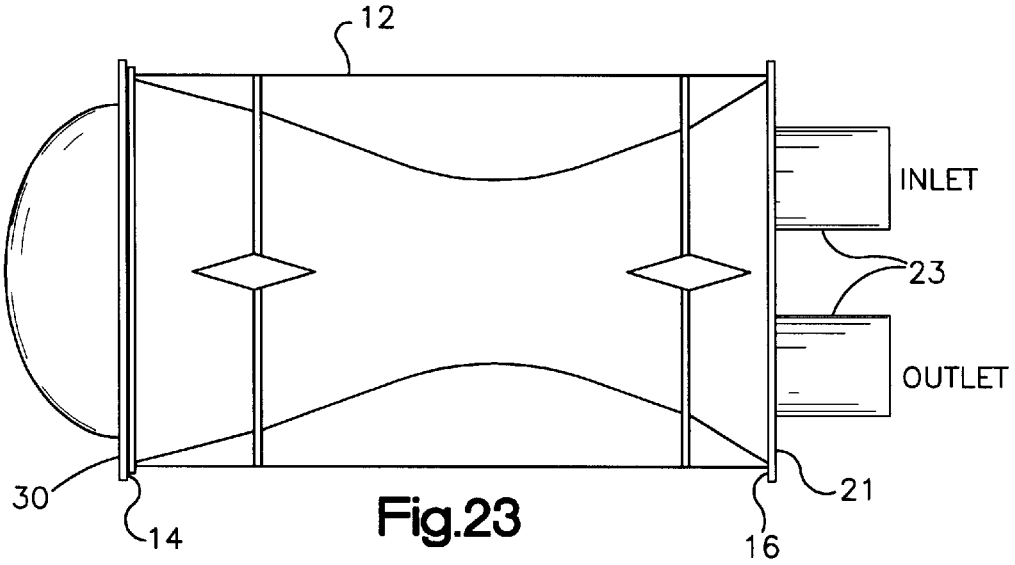
FIG. 23 shows a top, partial cross sectional view of the muffler body member provided at one open end with an adaptor end plate as shown in FIG. 7 and at another open end with an adaptor end plate as shown in FIG. 12.
Figure 28:
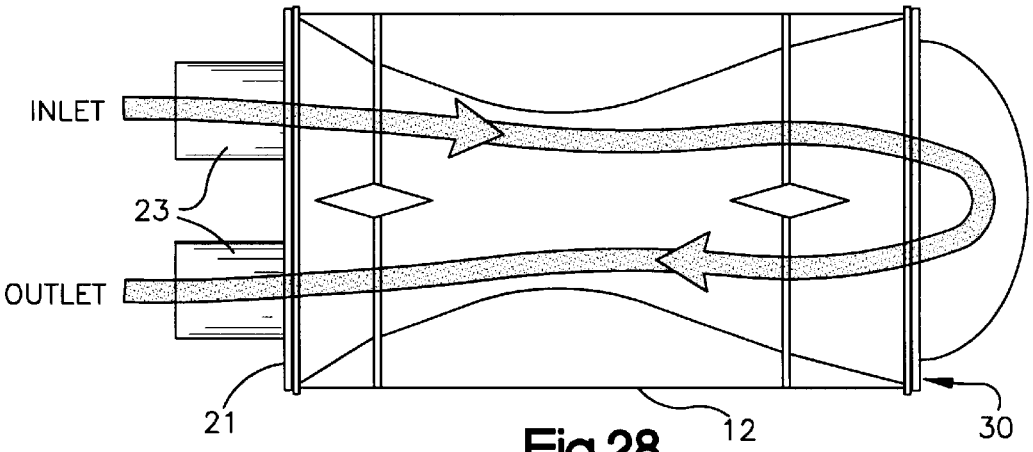
FIG. 28 shows a top, partial cross sectional view of the muffler body member provided at one end with the end adaptor shown in FIG. 7 and at the other end with the end cap shown in FIG. 12.

FIGS. 19, 20, 21, 22 and 23 illustrate how the various end structures of the muffler construction of the present invention may be combined with the central body portion 12 to provide a variety of exhaust gas flow configurations therethrough. FIG. 19 shows how the adaptor end 21 having dual tubes 23 can be applied to ends 14 and 16 of body member 12 with the result that there is provided an exhaust gas inlet and outlet on each of the ends 14 and 16. FIG. 20 shows that the same adaptor end 21 having the dual tubes 23 can be utilized so that the end 14 has two exhaust gas outlets and the end 16 has two exhaust gas inlets. FIG. 21 illustrates how the adaptor plate 21 with dual tubes 23 and the adaptor plate 26 with the singular tube 25 may be applied respectively to the ends 14 and 16 with the tubes 23 serving as exhaust gas outlets and the tube 25 serving as an exhaust gas inlet. FIG. 22 shows the central body 12 outfitted with the adaptor plate 24 (single off-set tube 23) on the end 14 and the dual-tube adaptor plate 21 on the end 16. In such arrangement, the tube 23 on the plate 24 functions as an exhaust gas outlet, and one of the tubes 23 on the plate 21 serves as an inlet, while the remaining tube 23 serves as an additional exhaust gas outlet. Lastly, FIG. 23 indicates how the end cap 30 and the dual tube adaptor plate may be included respectively on the ends 14 and 16. As most clearly shown in FIG. 28, application of the end cap 30 and the adaptor plate 21 as shown FIG. 23 allows the end cap 30 to serve as an exhaust gas deflector that diverts the flow of gas by 180 degrees and permits one of the tubes 23 on the plate 21 to be an exhaust gas inlet and the other tube 23 to be an exhaust gas outlet.

Figure 31:
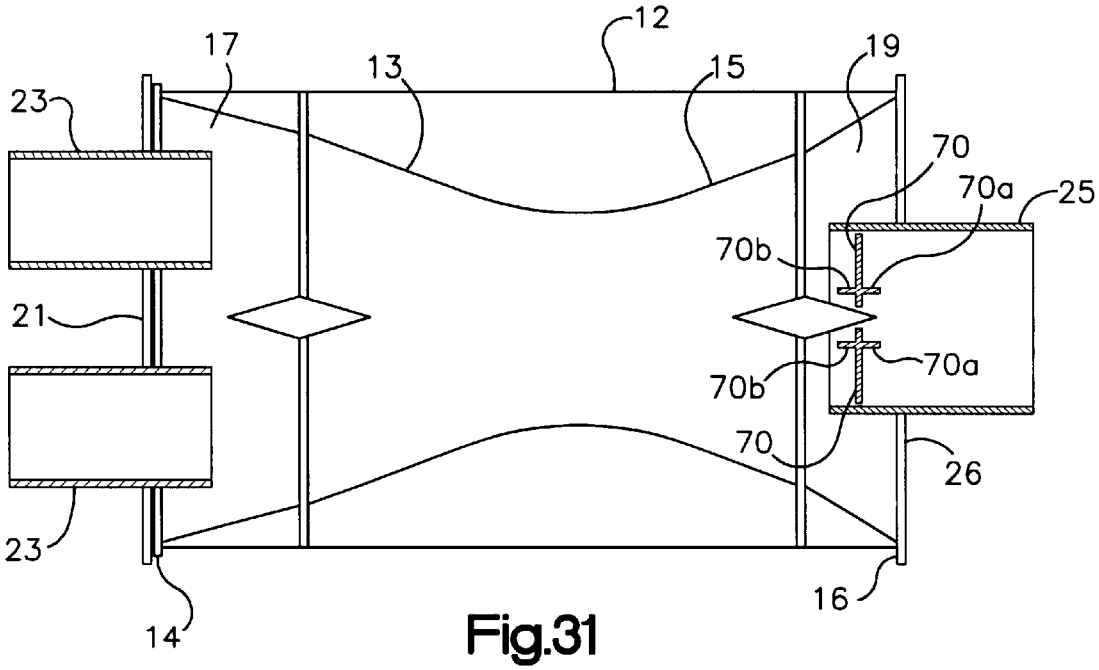
FIG. 31 shows a top, partial cross sectional view of the muffler body member provided with spark arresters within the second end chamber thereof.

FIG. 31 illustrates how the muffler construction may be provided with spark arresters 70. The spark arresters 70 are enclosed within the end chamber 19 and are secured to the inboard side of the adaptor plate 26 so that they are exposed at their longitudinally outer most sides 70*a* with the innermost open end of the tubular extension 25 and at their longitudinally innermost sides 70*b* to the interior of the chamber 19 and to the end portions the diagonal tubes 13 and 15 that are received by the chamber 19. While the muffler construction shown in FIG. 31 may be beneficially incorporated into the exhaust system of almost any vehicle, such construction has been found to be particularly useful for off-road vehicle applications. It should also be recognized that while FIG. 31 shows the spark arresters 70 be utilized with the adaptor plate 26 and the tubular extension 25, the spark arresters may just as easily be used with other adaptor plate/tubular extension combinations, e.g., the plate 20 and the extension 23 as shown in FIG. 10.

Figure 32:
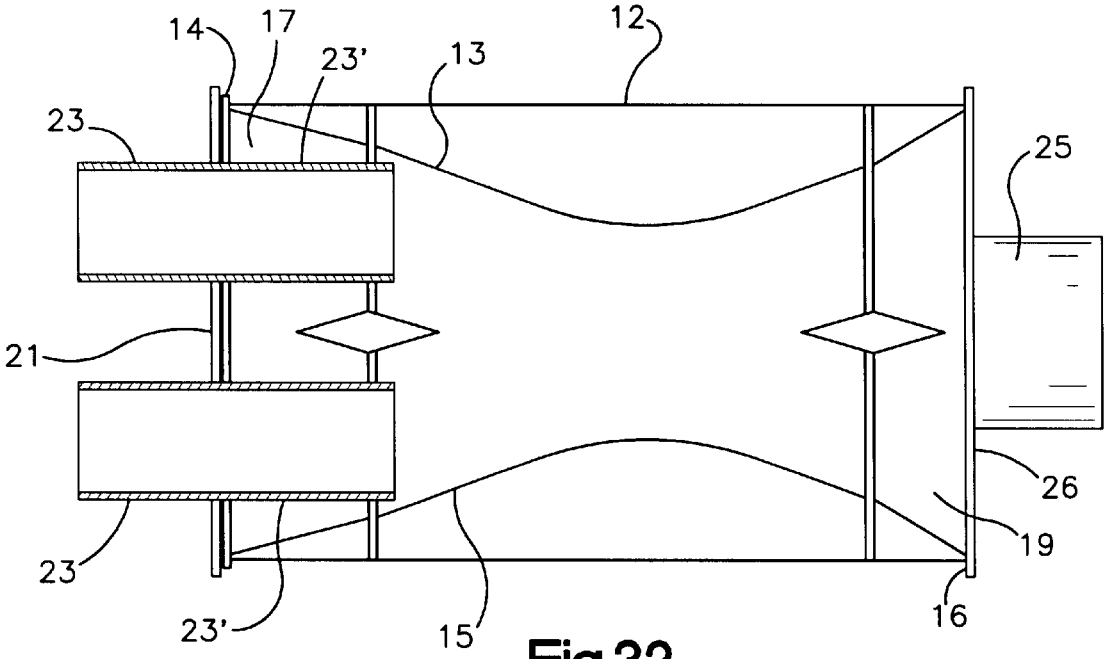
FIG. 32 shows a top, partial cross sectional view of the muffler body member provided with elongated, exhaust gas carrying tubes extending into the end chamber of the body member and toward the diagonally arranged tubes within the central portion of the body member.

FIG. 32 shows how the muffler construction of the present invention may include a pair of exhaust gas carrying tubes 23 that extend from the outboard side of an end adaptor plate 21, through the plate orifices, into the end chamber 17 of the body member 12 and to open ends of the diagonally arranged tubes 13 and 15 situated within the central portion of the body member 12. The extension portions 23' of the tubes 23 that extend through the chamber 17 can be louvered and/or perforated in order to obtain desired flow and sound levels.

Figure 24:
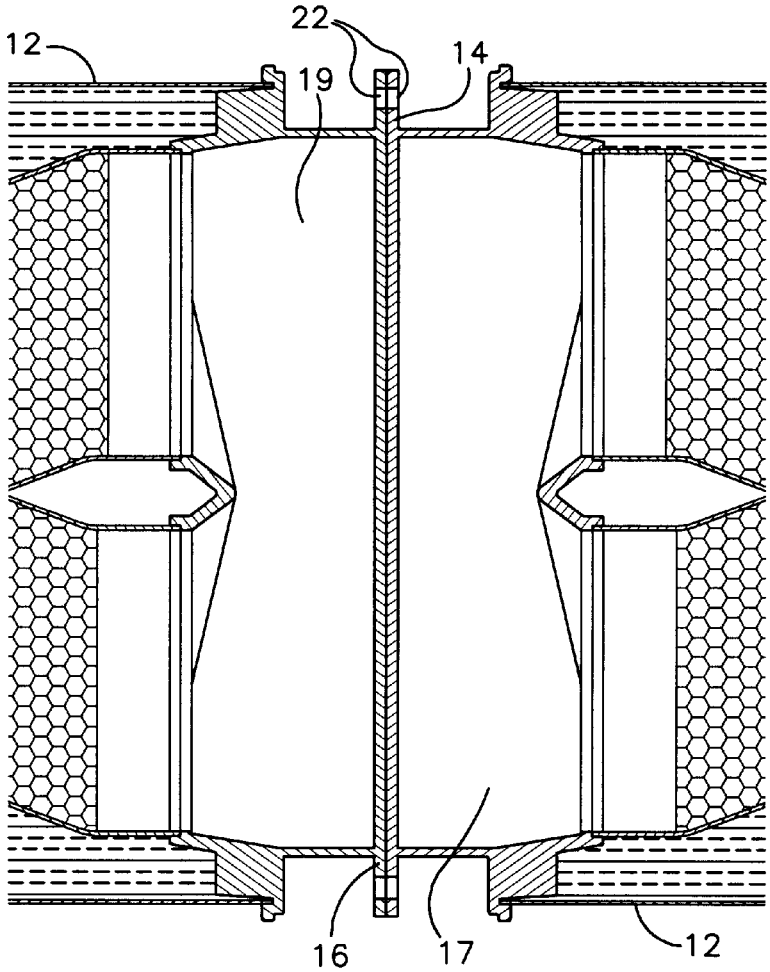
FIG. 24 shows a top, partial cross sectional view of two muffler body members of the present invention arranged in direct end-to-end contact.
Figure 25:
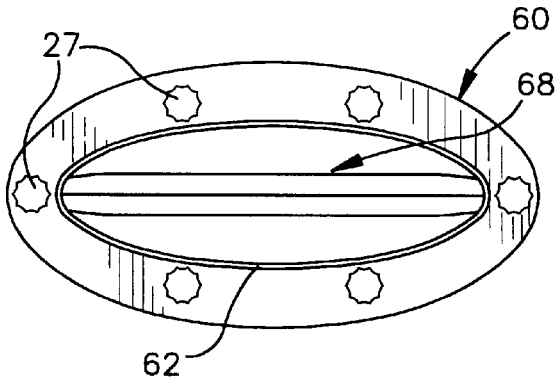
FIG. 25 shows a front view of a body adaptor of the modular muffler construction of the present invention.
Figure 26:
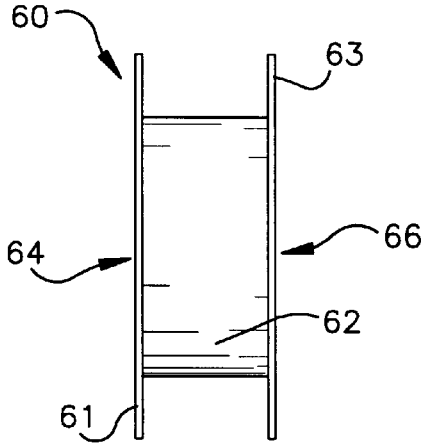
FIG. 26 shows an side view of a body adaptor shown in FIG. 25.
Figure 27:
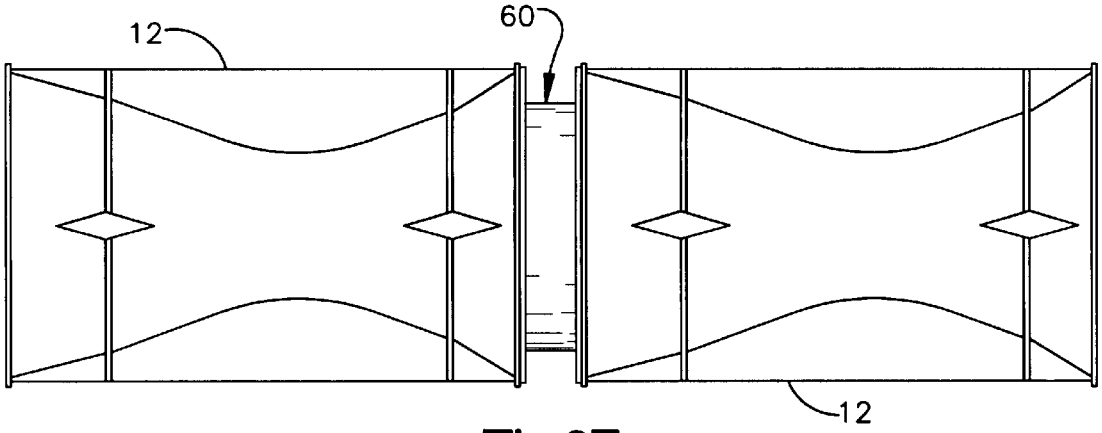
FIG. 27 shows a top, partial cross sectional view of two muffler body members joined by the body adaptor shown in FIGS. 25 and 26.

FIGS. 24 and 27 show two of the ways in which two (or more, if desired) of the muffler central bodies 12 may be linearly arranged in order to provide a multiple muffler exhaust system tailored to a specific type of vehicle and engine used therewith. FIG. 24 shows the instance in which two of the muffler central bodies 12 are joined in direct end-to-end contact with the end 14 of one of the bodies 12 abutted against the end 16 of the other of the bodies 12 with such abutment is effected by bringing the plurality of bores 22 provided in the flanged portion of the respective ends 14 and 16 and securing them together by inserting and tightening a fastener 27 (not shown) in the aligned pairs of bores 22. FIG. 27 shows the case where two of the muffler central bodies 12 are joined by way of a body adaptor 60. As shown in FIGS. 25 and 26, the body adaptor 60 is comprised of an oval-shaped central duct section 62 that is open at both of its longitudinally separated ends 64 and 66 which serve as either an inlet or an outlet for exhaust gas. Each of the ends 64 and 66 is provided with an outwardly extending flange 61 and 63. Like the flange 14 of the muffler central body 12, the flanges 61 and 63 are provided with a plurality of bores 22 that are alignable with the bores 22 provided in the flange 14 and that with insertion and tightening fastener 27 effect a secure adjoinment of the central muffler bodies 12. As further shown in FIGS. 25 and 26, the body adaptor 60 may be provided internally with a deflector plate 68. The deflector plate preferably will extend laterally across the oval duct section 62 and will have a generally wedge-shaped cross section.

Figure 29:
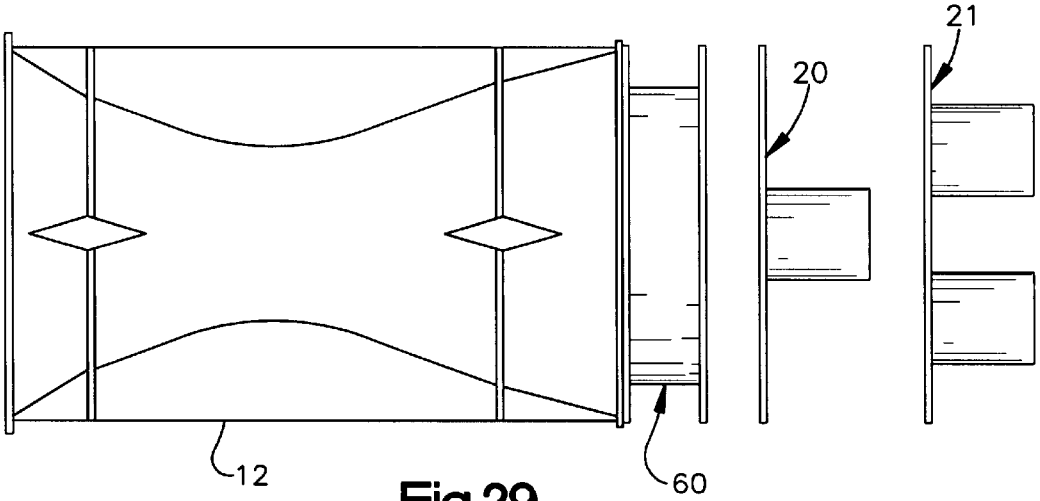
FIG. 29 shows a top, partial cross sectional view the muffler body member provided at one of its ends with body adaptor shown in FIGS. 25 and 26.

FIG. 29 suggests ways in which the body adaptor 60 may alternatively be utilized either singly with only one of the muffler central bodies 12 or in cooperation with one of the other end structures of the muffler construction of the present invention, such as the end adaptor plates 20 or 21.

Figure 30:
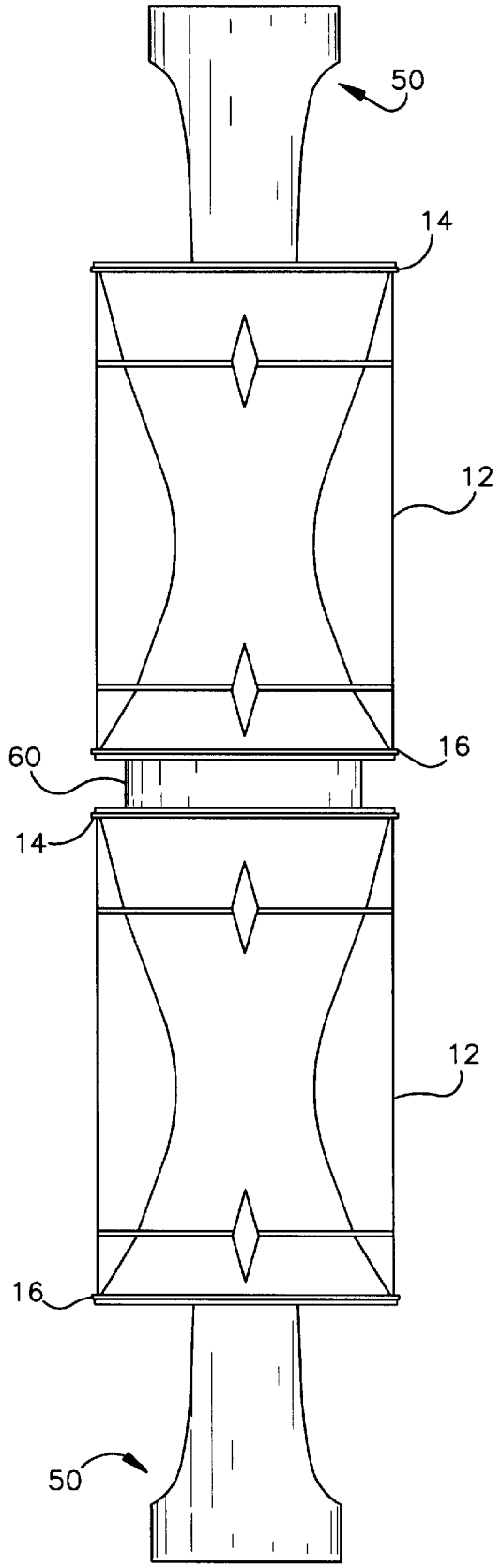
FIG. 30 shows a top, partial cross sectional view of two muffler body members joined together at their innermost ends by the body adaptor shown in FIGS. 25 and 26 and provided at each of their outermost ends with the vehicle adaptor shown in FIG. 15.

FIG. 30 is exemplary of a manner in which more than one of the muffler central bodies 12 may be configured for use not only with the vehicle adaptor 50, but also with the body adaptor 60. As specifically shown in FIG. 30, two muffler central bodies 12 have been joined at the innermost of their ends 14 and 16 by the body adaptor 60. Additionally, the bodies 12 are each provided at the outermost of their ends 14 and 16 with one of the vehicle adaptors 50. The vehicle adaptors are joined to the ends 14 and 16 of the bodies 12 via the same method as is used to join the other end structures of the construction of the present invention, i.e., via the fasteners 27. The assembly of muffler bodies 12 with the vehicle adaptors 50 depicted in FIG. 30 is envisioned to be suitable to adapt the muffler/body adaptor combination, which might otherwise be useable with the exhaust system of an automobile engine, for use with the exhaust system of a much larger heavy duty truck engine. By suitably varying the dimensions of the vehicle adaptor in response to the dimensions of the exhaust system hardware of yet other types and models of vehicles the muffler/body adaptor combination shown in FIG. 30 as well as a multitude of other combinations may be applied to a variety of other vehicle types and models.

In use the various embodiments of the present invention create a system of interchangeable parts that are selectively connected in order to create a muffler with the proper characteristics for various vehicles. Accordingly, a service center or muffler shop utilizing the system, will no longer need to stock numerous different mufflers for different vehicles. The facility will utilize a body member with the proper characteristics for the selected vehicle, and will match the necessary end plate adapters with the selected body member to provide a suitable muffler for the selected vehicle. It should be noted that the system may include body members having characteristics suitable for a number of different vehicles.

While the preferred embodiments of the invention has been described above, it will be recognized and understood that various modifications may be made therein.

What is claimed:

1. A muffler system comprising:

a muffler housing comprising at least one body member having first and second open ends, and first and second internal end chambers adjacent to each open end;

a first gas exchange plate affixed to said first end of said muffler housing and a second gas exchange plate affixed to said second end of said muffler housing, said gas exchange plates adaptable for attachment to at least one exhaust pipe;

wherein said at least one body defines a gas passageway formed between said first and second internal end chambers adjacent each open end, which narrows from an inlet end to a position within said at least one body member and widens to an outlet end.

2. A muffler system as recited in claim 1, wherein said gas passageway is perforated.

3. A muffler system as recited in claim 1, wherein said gas passageway is louvered.

4. A muffler system as recited in claim 1, further comprising sound deadening material affixed within said body member positioned radially outward from said gas passageway.

5. A muffler system as recited in claim 1, wherein said first and second gas exchange plates are selected from the group comprising:

a base plate and at least one tubular member extending therefrom;

a base plate with a closed dome;

a base plate with a dome and an tubular member extending therefrom;

a base plate and a substantially conical member extending therefrom;

a base plate and a substantially funnel-shaped member extending therefrom, said funnel-shaped member having a cylindrical attachment portion, a semi-hyperboloid intermediate portion, and a cylindrical end portion.

6. A muffler system as recited in claim 1, wherein said first and second gas exchange plates further comprise means for adjusting said first and second gas exchange plates inwardly and outwardly from said first and second internal end chambers.

7. A muffler system as recited in claim 1, further comprising at least one spark arrester affixed within at least one of said internal end chambers of said muffler housing.

8. A muffler system as recited in claim 1, wherein said first gas exchange plate further comprises an inboard side and an outboard side and at least one tubular extension attached to the inboard side of at least one of said gas exchange plates, said at least one tubular extension adapted to extend into said gas passageway.

9. A muffler system as recited in claim 1, wherein said muffler housing comprises two muffler body members selectively attached to each other.

10. A muffler system as recited in claim 8, wherein said two muffler body members are attached by a coupling member.

11. A modular muffler system as recited in claim 10 wherein said coupling member comprises a deflector plate.

12. A muffler system as recited in claim 1 further comprising a deflector plate to act as a flow restrictor to control exhaust flow and sound.

13. A muffler system as recited in claim 1, wherein the gas passageway is X shaped.

14. A muffler system as recited in claim 1, wherein the gas passageway has a narrowest area generally at the midpoint of the gas passageway.

15. A method of constructing a muffler comprising:

selecting a muffler housing comprising at least one body member having a first and second open ends with a coupling system;

selecting a first and a second gas exchange plate from a plurality of gas exchange plates comprising at least one single tube configuration and at least one double tube configuration;

removeably attaching the first gas exchange plate to the first open end of the at least one body member;

removeably attaching a second gas exchange plate to the second open end of the at least one body member.

16. The method as recited in claim 15, further comprising selectively attaching two or more of said muffler body members together.

17. The method as recited in claim 15, further comprising attaching said two or more muffler body members together with a coupling member.

18. A method as recited in claim 16, further comprising changing the exhaust flow and sound by attaching a deflector plate.

19. A modular muffler kit comprising:

a muffler housing comprising at least one body member having a first and second open ends with a coupling system;

a plurality of first gas exchange plates comprising at least a single tube plate and a double tube plate;

a plurality of second gas exchange plates comprising at least a single tube plate and a double tube plate;

wherein selection of one first and second gas exchange plates provides alternate inlet and outlet configurations, with each of said first and second gas exchange plates having couplers to be selectively engaged to said coupling system of said at least one body member.

20. A modular muffler kit as recited in claim 19, further comprising one or more body coupling member.

21. A modular muffler kit as recited in claim 19, further comprising an exhaust flow deflector plate.

22. A modular muffler kit comprising:

a muffler housing comprising at least one body member having a first and second open ends with a coupling system;

a plurality of first gas exchange plates;

a plurality of second gas exchange plates;

wherein said pluralities of first and second gas exchange plates comprise a single center tube plate, a single offset tube plate, a double tube plate, and a dome plate;

wherein each of said pluralities of first and second gas exchange plates having couplers to be selectively engaged to said coupling system of said at least one body member.

* * * * *

UNITED STATES PATENT AND TRADEMARK OFFICE

CERTIFICATE OF CORRECTION

PATENT NO. : 6,470,998 B1
DATED : October 29, 2002
INVENTOR(S) : James E. White

It is certified that error appears in the above-identified patent and that said Letters Patent is hereby corrected as shown below:

Column 1,
Line 5, add:
-- This application claims the benefit of U.S. Provisional Applications Serial No. 60/161,529 filed October 26, 1999 and 60/166,789 filed November 22, 1999. --

Signed and Sealed this

Twentieth Day of May, 2003

JAMES E. ROGAN
*Director of the United States Patent and Trademark Office*